United States Patent [19]

Taylor

[11] Patent Number: 4,663,503

[45] Date of Patent: May 5, 1987

[54] MHD PINCH INTERRUPTING SWITCH FOR HIGH CURRENTS

[75] Inventor: Owen S. Taylor, Jeannette, Pa.

[73] Assignee: The United States of America as represented by the Secretary of the Navy, Washington, D.C.

[21] Appl. No.: 56,769

[22] Filed: Jul. 2, 1979

[51] Int. Cl.[4] ..... H01H 33/02

[52] U.S. Cl. ..... 200/144 R; 200/148 R; 335/51

[58] Field of Search ..... 200/144 R, 148 R; 335/51, 49, 50

*Primary Examiner*—Robert S. Macon

*Attorney, Agent, or Firm*—Arthur A. McGill; Prithvi C. Lall; Michael J. McGowan

[57] ABSTRACT

Switching apparatus for very high currents utilizes the magneto hydrodynamic pinch effect to interrupt a liquid metal column that occupies the gap between a pair of spaced conductors maintained apart by an insulating sleeve. The on/off condition of the switching apparatus is controlled by regulating the relationship between the fluid pressure within the sleeve and $P_p$, the MHD pinch pressure.

10 Claims, 5 Drawing Figures

INERT GAS SUPPLY
31
14
12
10
11
17
16
13
15
20
19
30
13
$I_{D.C.}$
$I_{D.C.}$
18
21
34
32
35
33

MHD PINCH INTERRUPTING SWITCH FOR HIGH CURRENTS

The present invention relates generally to electrical switching apparatus and, more particularly, to switching arrangements for interrupting very high currents which employ the magneto hydrodynamic pinch effect in their operation.

Ship propulsion systems utilizing DC superconducting motors are being developed because of the advantages these motors offer in size and weight reduction. In the operation of such motors, load currents in the order of 5,000 amps may be required to be switched a multiplicity of times during each cycle of the power supply voltage. Since a typical machine inductance may be approximately $50\times10^{-6}$h, comparatively large amounts of heat have to be dissipated within the switch during each current interruption. Conventional switching devices are not well suited to this mode of operation because, among other reasons, their performance involves the movement of complex electromechanical components and linkages. Additionally the contact elements of these assemblies usually must be frequently examined and replaced because of surface erosion and pitting caused by arcing. If this arcing is quenched by its confinement within an oil reservoir, for example, periodic checks also have to be carried out to insure that excessive carbonization has not occurred and that the oil has sufficient dielectric strength.

It is, accordingly an object of the present invention to provide a switching arrangement for interrupting high currents which has a static mode of operation.

Another object of the present invention is to provide a liquid metal magneto hydrodynamic pinch interrupting switch for very high AC and DC currents.

Another object of the present invention is to provide a switching arrangement wherein the interruption takes place within a liquid metal column that is first constricted and then broken by a magneto hydrodynamic pinch pressure.

Briefly and in general terms the above objects of invention are realized by utilizing as the circuit interrupting means the so-called static magneto hydrodynamic (MHD) pinch. It is well known that if a current is passed along a column of conducting fluid an azimuthal magnet field is produced. This field interacts with the current responsible for it to produce a pressure that tends to pinch or constrict the fluid. If the liquid column is confined, this pinch gives rise to static pressure gradients and these gradients in the present invention are selectively controlled so as to cause a column of confined liquid metal which fills the gap between a pair of conductors to be broken and thereby interrupt the current flow between the conductors.

The switching sequence is controlled by regulating the pressure of the liquid metal within a switching chamber that consists of an insulating sleeve, that interconnects the conductors while maintaining them a fixed distance apart. When this pressure is above the MHD pinch pressure, the switch is closed. When it is below this pressure, the switch opens and effectively disconnects the two conductors.

Figure 1:
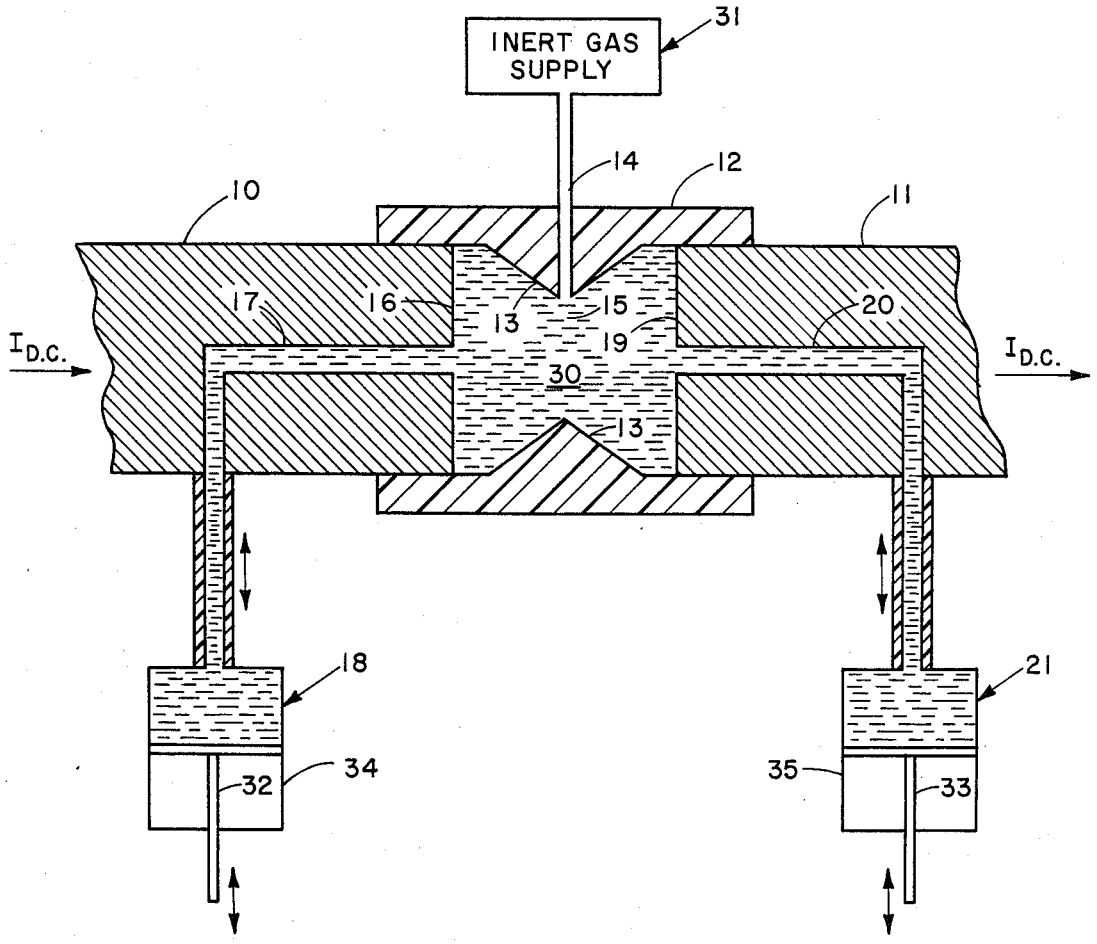
FIG. 1 is a preferred embodiment of the invention with the switch in a closed position.
Figure 2:
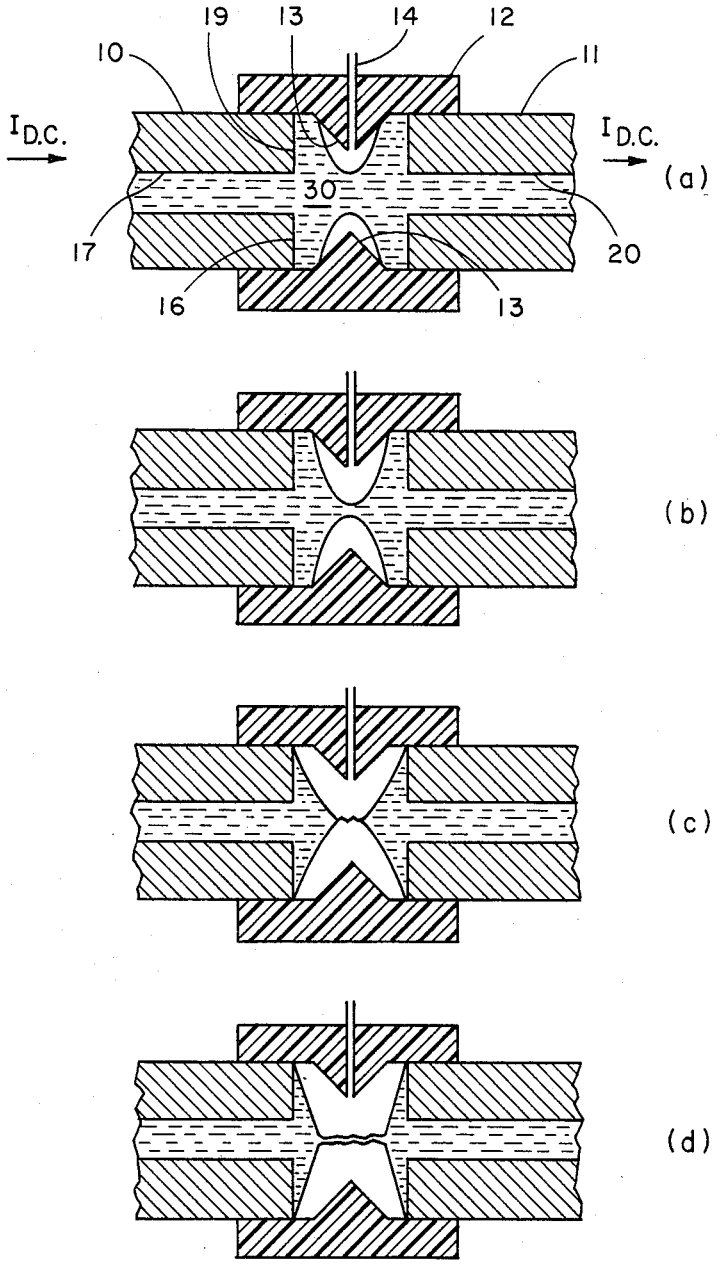
FIGS. 2(*a*)–2(*d*) illustrate various stage of the switch during opening of the switch.

Referring now to the drawings, FIGS. 1 and 2(*a*)–2(*d*) illustrate a preferred embodiment of the invention, it will be seen that a pair of conductors 10 and 11 are interconnected by an insulating sleeve 12 which maintains these conductors in a co-axial relationship with their confronting ends a fixed distance apart. Sleeve 12 which performs as a switching chamber is formed with an internal ring 13 which has a generally triangular cross section so that a well defined minimum area 15 exists at a location midway between the ends of the conductors. This minimum area is similar in configuration to the throat in a flow nozzle.

The interior of sleeve 12 communicates with two liquid metal supply sources 18 and 21. Suitable "L" shaped passageways such as 17 and 20 are formed within the end portions of conductors 10 and 11 so as to provide the necessary fluid pathways. In the particular arrangement shown, one end of passageway 17 terminates at the center of the end face 16 of conductor 10 and includes a horizontal length portion that coincides with the longitudinal axis of symmetry of conductor 10. Passageway 20 formed in conductor 11 is of similar construction.

Both liquid metal reservoirs 18 and 21 are maintained at the same pressure, $P_L$, and in one embodiment, contain the eutectic sodium potassium alloy NaK 78 which is widely used for liquid metal current collection in homopolar machines. The reservoirs are electrically insulated from each other by suitable means.

Insulating sleeve 12 is also formed with an internal passageway 14 or multiplicity of such passageways which traverse ring 12 so as to provide access to the throat area 30. Connected to these inlets is an inert gas supply which is maintained at a pressure $P_G$. This cover gas may be any gas that does not react with the liquid metal, such as nitrogen or argon, and in the case where the liquid metal is NaK its water vapor level should be essentially 0.

As mentioned hereinbefore, when a DC current flows through conductors 10 and 11, including the liquid metal column occupying the gap between them, a magneto hydrodynamic pressure will exist within the fluid column. According to Hughes and Young in their publication "The Electromagnetodynamics of Fluids", published by John Wiley and Sons, Inc., the MHD pinch pressure $P_p$ in the fluid conductor column may be expressed as:

$$P_p = \frac{\mu I^2}{4\pi^2 a^4}(a^2 - r^2) \tag{1}$$

where I is the current flowing through the conductor, $\mu$ is the permeability, a is the radius of the conductor and r is any radius within the conductor. The maximum pressure thus occurs at the center where r=0, while the pressure at the surface, where r=a, is zero. This surface thus will be drawn inwardly or pinched and it is this phenomenon which is utilized in the present invention to disrupt the liquid column and break the electrical circuit.

The operation of the switching apparatus is as follows:

To close the switch and maintain it closed so as to establish a current flow path between conductors 10 and 11, the pressure $P_L$ within liquid metal reservoirs 18 and 21 is held at a value such that the interior pressure within sleeve 12 exceeds $P_p$, the pinch pressure. This may be accomplished by adjusting the setting of pistons 32 and 33 within cylinders 34 and 35, respectively.

Pressure $P_p$, as seen from expression (1), is determined in part by the parameters of the conductors and the magnitude of the DC current flowing through these conductors and through the liquid metal column. When this current is to be interrupted and the switch opened, it is only necessary to lower $P_L$ below $P_p$. This can be done by any suitable mechanism that displaces pistons 32 and 33 in a downward direction by an appropriate amount. When this occurs, the reduced pressure on the liquid metal sides of each piston permits some of this metal to flow out of the interior of sleeve 12. This flow is abetted by the pumping action accompanying the formation of the pinch which develops at the throat area 15 because of the favorable geometry of this location with respect to the adjacent enlarged dimensions of the liquid column.

The displacement of the liquid metal is also facilitated by the location of the passageways 17 and 20 which are aligned along the central axis of the liquid column that corresponds to the center of the current field. The pinch effect ultimately results in the formation of an arc between separate volumes of the liquid metal that contact the confronting ends of conductors 10 and 11. It would be pointed out that the amount of liquid metal flow out of the switch should be metered by selecting the parameters of the apparatus such that the flow terminates before the end faces 16 and 19 of the conductors are exposed. This is to insure that these surfaces are kept cool and do not otherwise deteriorate.

As shown in FIGS. 2(*a*)–2(*d*), the liquid metal flows out of region 30 creating vacuum under different pressure conditions and the natural vacuum caused by the expulsion of the liquid metal by the pinch draws inert gas from supply 31 via passageway 14 into the throat area 15, the site of the arc, to aid in the extinguishment of an arc present as the liquid column breaks apart.

The pressure of the cover gas $P_g$ should be maintained equal to the liquid metal pinch pressure $P_p$ in order to prevent any fluid flow while the switch is closed and current is normally flowing between the conductors. When the switch is opened and liquid metal flows out of the switching chamber, the gas pressure within this member drops and draws cover gas into it. It would be pointed out that the pistons within the liquid metal reservoirs have only a limited travel to keep all of the liquid metal from flowing completely out of the chamber. During the switching process pressure within the liquid metal pinch is large compared to the gas pressure but despite this, gas at the lower pressure $P_g$ will be drawn into the chamber. From another point of view, the MHD pinch performs like a flexible container for the liquid metal and when it shrinks in size to force the liquid metal out of the chamber, gas is pulled into it to help in the extinguishment or suppression of any arc.

It would be pointed out that the arc formed when the liquid metal column is interrupted will self-extinguish if its resistance exceeds the inductive impedance of the circuit. If the resistance of the arc is not large enough to overcome the load circuit impedance, then it may be extinguished by any other conventional methods used in the electrical breaker art. For example, the arc may be blown out appropriate blast of the cover gas. Alternatively, it may be permitted to expand to the side wall of sleeve 12 and here it will self-extinguish because of its own instability, which is now of the "kink" type.

Where large inductances are encountered, quite large arc heat energy will be present. This heat energy may be removed by cooling coils coupled to the conductors or inserted directly into the liquid metal lines or supply, provided these coils do not interfere with the comparatively small liquid metal flow that takes place into and out of the switch during its operation. Likewise any ionized material caused by the arcing may be removed by circulating the inert gas through the interior of the switch.

It would also be pointed out that insulating sleeve 12 should be made of a material that is compatible with NaK as well as having a non-wetting characteristic when exposed to this liquid metal. Most ceramics qualify in this regard. For example, aluminum oxide is suitable provided it is of very high purity to insure its non-wetting at the temperatures of the liquid metal which will normally be above room temperature.

The above modification has the further advantage that contact cooling can be realized by supplying a continuous replenishment of fresh low temperature liquid metal to the interior of the sleeve where the current interruption occurs.

The MHD pinch effect may be utilized to interrupt both DC and AC currents. However, the mode of operation of the switch is somewhat different in each case. The direction of the pinch body force is independent of current direction, that is, it always acts inwardly. When an AC current is flowing between the conductors, the pinch pressure will decrease to zero as the current passes through zero. Thus, during each cycle of the AC current two pulsed pinch pressures will occur and liquid metal will be forced out of the switching chamber by a series of these pulses. This is in contrast to the DC current case where a steady pressure drives the liquid metal out of this chamber.

In the AC mode of operation the "skin" affect will modify the basic equation by Hughes and Young and the impedance across the switch will be altered. But these distinctions will not affect the basic concept involved in the operation of the switch.

What is claimed is:

1. A high DC current switch comprising in combination a first conductor;

a second conductor co-axially spaced therefrom;

insulating means interconnecting the confronting ends of said conductors and forming therewith a fluid enclosure;

a liquid metal supply connected to the interior of said enclosure; and means for regulating the flow of liquid metal into and out of said enclosure such that when the liquid metal pressure within said enclosure is above a specific hydrodynamic pinch pressure corresponding to a predetermined DC current flow through the liquid metal conduction path between said conductors the switch is closed and when it is below said pinch pressure as a result of liquid metal being discharged from said enclosure the switch is opened.

2. Switching apparatus for very high DC currents comprising in combination a first and second conductor adapted to be connected to a source of DC current;

an insulating sleeve intercoupling said conductors and maintaining them a fixed distance apart such that a gap exists between confronting ends of said conductors;

a liquid metal supply source connected to the interior of said sleeve for providing liquid metal for bridging said gap so as to permit current flow between said conductors; and means for controlling the liquid metal pressure within said sleeve so that this pressure is either above or below the hydrodynamic pinch pressure corresponding to a specific current flow in the liquid metal bridging said gap.

3. In an arrangement as defined in claim 2 wherein said liquid metal is the eutectic sodium potassium alloy NaK 78.

4. In an arrangement as defined in claim 2 wherein said means for controlling the liquid metal pressure includes means for permitting amounts of said liquid metal to be discharged from the interior of said sleeve, said flow being aided by said hydrodynamic pinch pressure.

5. In an arrangement as defined in claim 2 a fluid passageway formed in the confronting end portions of said conductors;

each passageway terminating at a location at the end of the conductor that is at the central axis of the liquid metal column filling said gap and at a location on the outer surface of the conductor which is exterior of said sleeve.

6. In an arrangement as defined in claim 2 wherein said insulating sleeve is formed with a restricted throat; and a supply of inert gas coupled to said throat for assisting in the extinguishment of any arc formed within said sleeve.

7. Switching apparatus comprising in combination first and second conductors;

an insulating sleeve interconnecting one end of each conductor and maintaining said conductors in spaced coaxial alignment, said sleeve having an internal constriction that acts as a restricted throat;

a supply of liquid metal coupled to the interior of said sleeve;

means for pressurizing said supply such that liquid metal is forced into and occupies the interior of said sleeve whereby a liquid metal conducting path is formed between said conductors; and means for selectively reducing said pressure to a value such that the pinch pressure caused by the DC current then flowing through said path forces liquid metal back into said supply and disrupts said path whereby the current flow between said conductors is interrupted.

8. In an arrangement as defined in claim 7 a supply of inert gas coupled to said throat for assisting in the quenching of any arc formed when said path is disrupted.

9. In an arrangement as defined in claim 7 wherein said liquid metal is the eutectic sodium potassium alloy NaK 78.

10. In an arrangement as defined in claim 7 wherein said liquid metal supply is coupled to the interior of said sleeve through a passageway that terminates at one end at a location on the end of each conductor that is opposite said throat.

* * * * *